109-84 SR
12/27/83 XR 4,422,386

United States Patent [19]
Carpenter

[11] 4,422,386
[45] Dec. 27, 1983

[54] SAFE AND METHOD OF MAKING THE SAME

[75] Inventor: Britt C. Carpenter, Penfield, N.Y.

[73] Assignee: John D. Brush & Co., Inc., Rochester, N.Y.

[21] Appl. No.: 246,864

[22] Filed: Mar. 23, 1981

[51] Int. Cl.[3] ..... E05G 1/026
[52] U.S. Cl. ..... 109/59 R; 109/65; 109/79; 109/84; 292/169.23; 292/336.3
[58] Field of Search ..... 109/65, 80, 82, 84, 109/83, 58, 59, 1 R, 23, 49.5, 10, 78, 79; 70/346, 173, 169, 162; 52/309.9, 407; 292/169 R, 169.23, 336.3

[56] References Cited

U.S. PATENT DOCUMENTS

| | | | |
|---|---|---|---|
| 902,051 | 10/1908 | Brintnall et al. | 109/83 |
| 1,252,790 | 1/1918 | Dick et al. | 109/82 |
| 1,554,395 | 9/1925 | Young | 109/84 |
| 2,179,678 | 11/1939 | Wenzel | 52/407 |
| 2,330,941 | 10/1943 | Acuff, Jr. | 52/407 |
| 3,550,412 | 10/1970 | Pitel et al. | 292/251 |
| 4,048,926 | 10/1977 | Brush, Jr. et al. | 109/65 |
| 4,178,859 | 12/1979 | Seiz et al. | 109/83 |
| 4,263,365 | 4/1981 | Burgess et al. | 423/310 |

FOREIGN PATENT DOCUMENTS

| | | | |
|---|---|---|---|
| 2852982 | 10/1979 | Fed. Rep. of Germany | 109/80 |
| 21762 | of 1909 | United Kingdom | 109/84 |

*Primary Examiner*—Gene Mancene
*Assistant Examiner*—David L. Tarnoff
*Attorney, Agent, or Firm*—Stonebraker, Shepard & Stephens

[57] ABSTRACT

A safe having an outer shell mainly of plastic material, an inner liner of metal, and a filling of heat-resistive material between the shell and the liner. The safe body has a separate cover or door across the top of the body, and when the door is removed, it allows unhampered access to the complete area of the liner, which constitutes the storage space for the articles to be protected. Both in the safe body and the separate door, the filling material is put in while in a flowable condition, and filling is stopped when the space is not quite full. The panel members which are then put in place to close the filling openings have projections which make contact with the filling material to give stability and firmness to the panel members even though large areas of the panel members may not be in contact with the filling material. A simple latch and key mechanism is also disclosed.

9 Claims, 15 Drawing Figures

SAFE AND METHOD OF MAKING THE SAME

BACKGROUND OF THE INVENTION

This invention relates to a safe and the method of making it. It deals particularly with small safes such as are used in homes and offices to give some degree of protection against theft but especially to give protection against destruction of papers and valuable records in the case of fire.

It is an object of the invention to provide an improved safe of this kind, especially one having improved access to the contents of the safe through a large top opening, and a safe having improved styling and visual attractiveness, and an improved method for manufacturing such a safe, so that it may be made economically. Another object is the provision of a safe design giving increased protection for the contents of the safe in the case of a fire.

SUMMARY OF THE INVENTION

According to the invention, the safe has an outer shell of molded plastic material, an inner liner of metal such as steel, and a filling of insulation material between the shell and the liner. The shell is made in two sections, a body section and a base section which are hermetically sealed to each other, as by solvent welding, during assembly, and the metal liner is also hermetically sealed at its edges to the shell. The base section has a large opening through which the filling of insulation material may easily be poured while the structure is in an inverted position, and then this filling opening is closed by a metal plate.

The top of the body is completely opened for easy access to the contents of the safe, and is closed when desired by a separate door member or closure member which lies horizontally across the open top of the body and is locked in place by a lock mechanism. The door, like the body, is made up of two molded plastic outer sections (a cover section and a jamb section) secured to each other, and a metal bottom plate or linear plate secured to the jamb section. After the jamb section and the bottom plate have been assembled, the space or cavity thus formed is filled with insulation material in a still plastic or flowable state, then the cover section is applied and is secured in place. The plastic cover section of the door has a series of projections at intervals throughout its area, which extend into the insulation filling while it is still soft and become firmly embedded therein after the filling hardens, to give rigidity to the top surface of the door.

The body of the safe is stepped or recessed at the bottom to provide a downwardly faced horizontal shoulder slightly above the floor level, all the way around the perimeter of the structure, to facilitate grasping the safe and lifting it to move it from one location to another.

DESCRIPTION OF THE PREFERRED EMBODIMENTS

The safe of the present invention, in its preferred form, comprises a body having an outer shell and an inner liner, with a heat-resistive filling between the shell and the liner, and also a door or cover for closing the otherwise open top of the body, the cover having spaced top and bottom walls with a heat-resistive filling between them. A lock is provided on the cover, for locking it in closed position relative to the body.

The body is so designed that it may be manufactured in two different heights, a lower height adapted to contain smaller envelopes of documents or business papers, and a higher style adapted to contain larger envelopes or folders of documents or business papers. The top opening of both heights of body is preferably the same, so that only a single kind or style of cover or door needs to be manufactured, to fit both styles of body. The body is built up of several components, and is preferably designed so that certain of the components are identical in both the high and the low styles of body, thus reducing the expense of manufacture and the inventory of parts.

Figure 1:
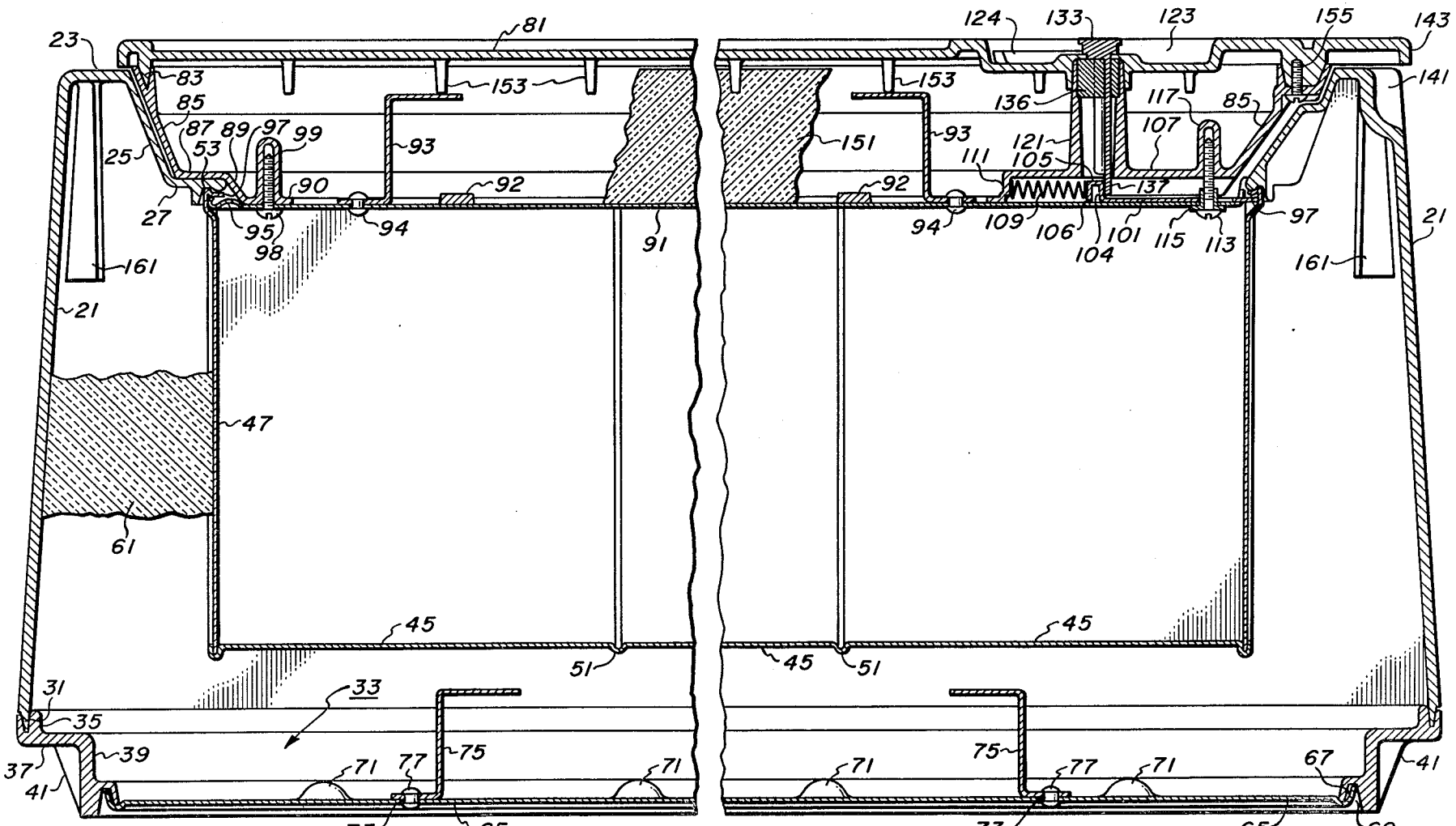
FIG. 1 is a fragmentary vertical section taken longitudinally approximately along the center line of a safe in accordance with a preferred embodiment of the invention.
Figure 2:
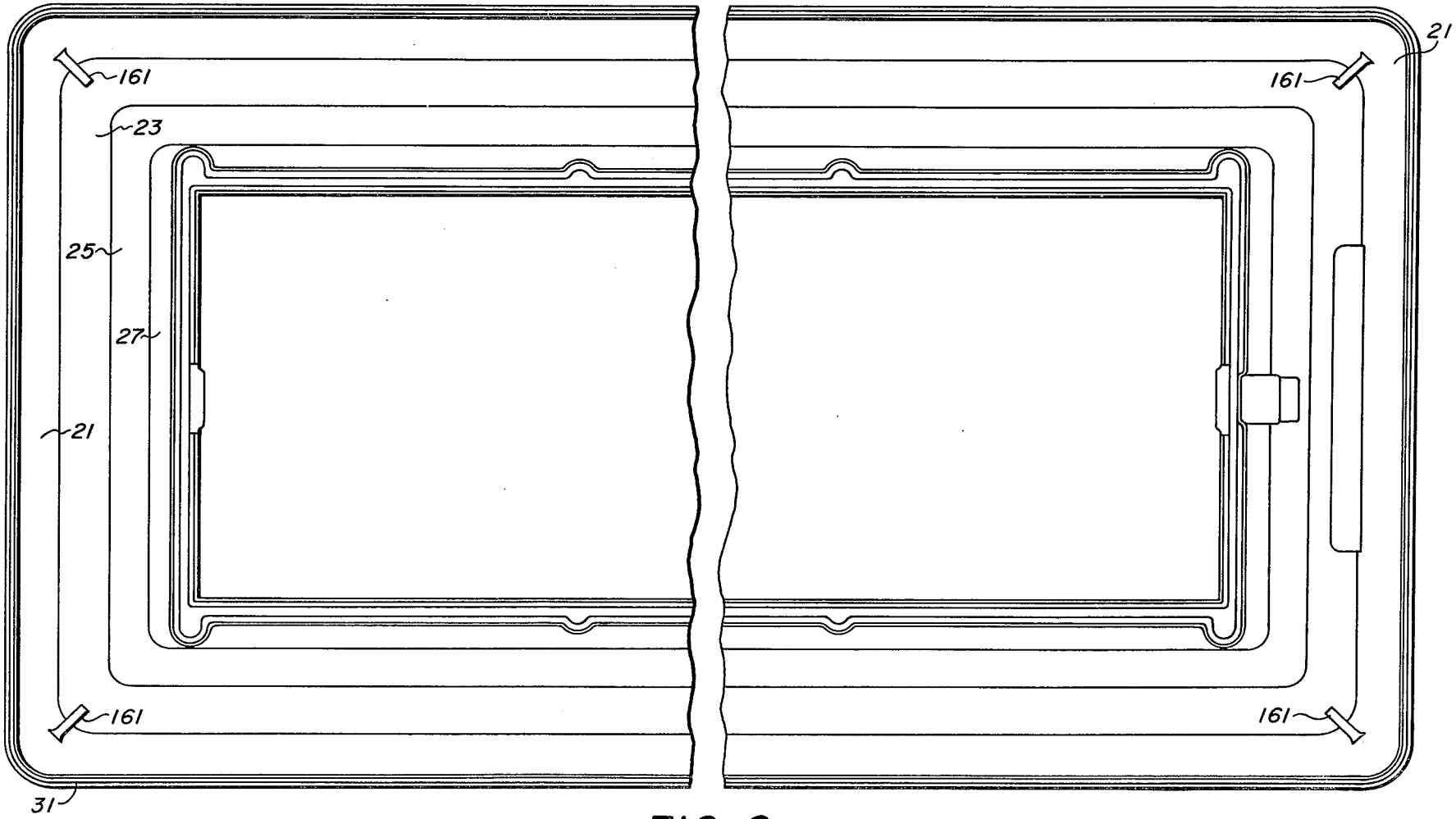
FIG. 2 is a fragmentary bottom view of the main body member of the safe shown in FIG. 1, with parts of this body member broken away and with other members removed.

Referring now to the drawings and particularly to FIG. 1, the body comprises a main outer section 21 of high strength and reasonably rigid plastic material, the upper edge of which extends inwardly for a short distance at 23 and then obliquely downwardly at 25 and inwardly again at 27, the portions 25 and 27 forming a jamb section to mate with a door or cover. The body is, in horizontal section or plan, of rectangular shape, as seen in FIG. 2. The bottom edge of the main body section 21 is formed as a thin sharp edge as illustrated at 31, to fit snugly in a corresponding tapered groove formed in the top of a molded plastic base member indicated in general at 33.

This base member is formed with an upstanding flange portion 35 in which the groove for receiving the lower edge of the body 21 is formed, and from the bottom of this upstanding flange 35 the base portion extends inwardly horizontally for a short distance at 37, and then downward obliquely at 41 to the lower edge which is flat and adapted to rest on the floor, table, or other flat supporting surface. Thus a narrow shoulder is formed for grasping by the fingers to lift the safe. However, at two points, at opposite ends of the safe, wider finger grip ledges are provided, by carrying the wall section 37 further inwardly horizontally, and then vertically downwardly at 39 instead of on a slant as at 41.

The base member 33 is preferably formed of the same plastic material used for the main body member 21. These two members might be formed as a single integral member, but it would be a difficult shape to mold as a single piece, and it is more practical to mold them as two separate pieces, subsequently securing them together when the tapered sharp edge at the bottom of the body member 21 is fitted into the tapered receiving groove at the top of the base member. The securing may be done by solvent welding, or by using a suitable adhesive such as one of the adhesives mentioned hereafter.

Figure 5:
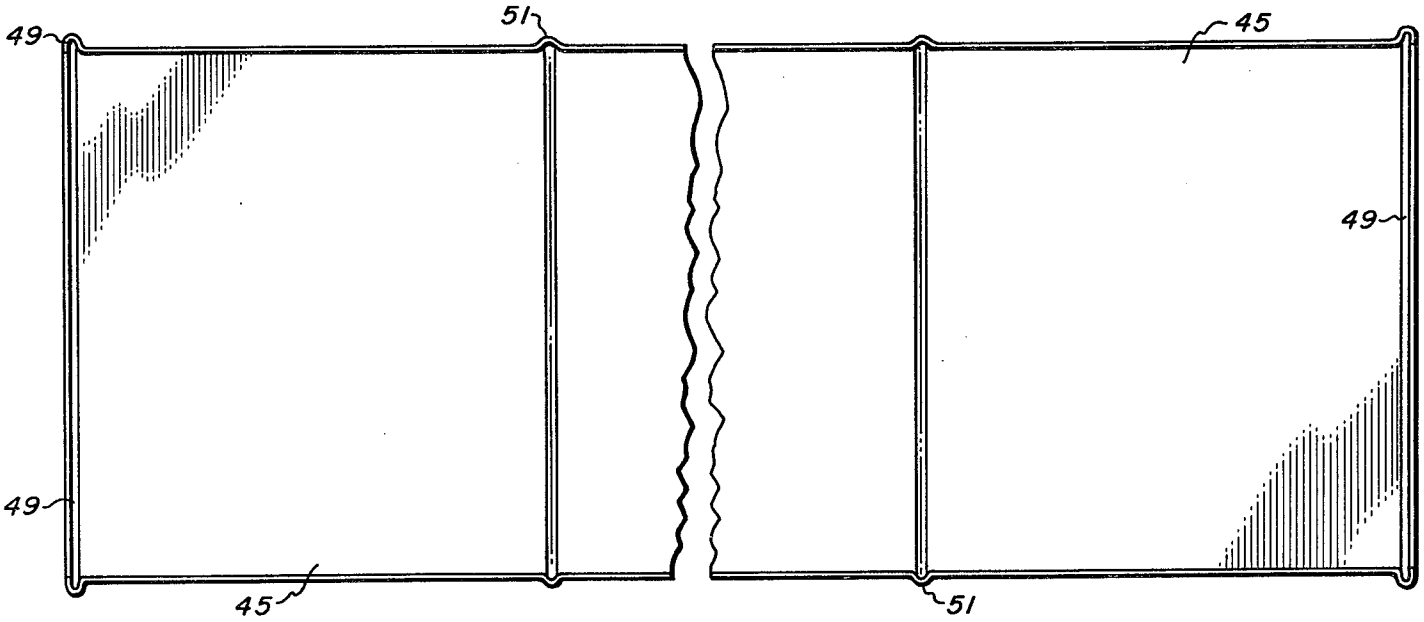
FIG. 5 is a top plan view of the main portion of a metal liner used in the safe.
Figure 6:
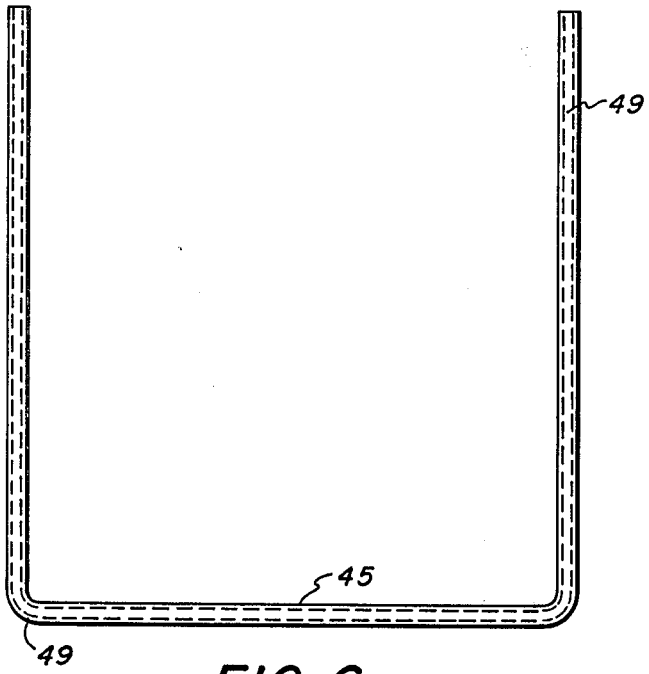
FIG. 6 is an end view of the same.
Figure 7:
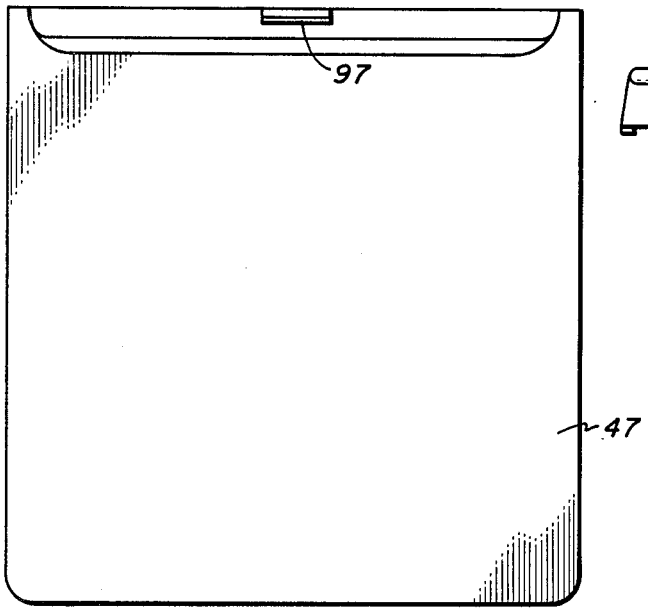
FIG. 7 is a face view of an end plate of the metal liner.

Hermetically sealed into the body member is a metal liner indicated in general at 45. This liner is of U-shaped cross section as best seen in FIG. 6. It comprises a piece of sheet metal formed into a U-shape or trough-like body 45, FIGS. 5 and 6, and two end plates 47, FIG. 7, which close the ends of the trough. Both ends of the main body 45 are provided with small channels 49 for receiving the edges of the respective end plates 47. The channels are crimped tightly over the edges of the end plates to make a hermetic seal. This avoids the necessity of welding the end plates to the liner body, which welding would be difficult or impossible if, as preferred, both the liner body and the end plates are formed from precoated steel.

The body of the liner also has stiffening ribs 51 formed in a circumferential direction around the three sides of the liner body, at intervals along the length of the body. For a liner body having a length of about 12 inches, two such stiffening ribs are appropriate, spaced at intervals of about 4 inches from each other and from the ends of the liner.

The upper edge of the liner body and of the end members fits snugly in a shallow groove 53 formed in the under face of the final horizontal flange 27 of the main body 21 of the safe. The upper edge of the liner is permanently and hermetically sealed to this flange 27. This is accomplished by using an adhesive which is resistant to moisture, and which is not brittle so that it will not fracture when the safe is dropped, and which is resistant to and not adversely affected by the alkali in the insulation filling of the safe. A suitable adhesive which has these characteristics and which is satisfactory for bonding the metal liner 45, 47 to the plastic body is the elastomeric synthetic rubber product known as "Plio-Seam," manufactured by Goodyear Tire & Rubber Company of Akron, Ohio. Another suitable adhesive for this purpose is the cyanoacrylate adhesive known as "Bostik 7435," made by the Bostik Division of USM Corporation of Middleton, Mass. These adhesives are suitable not only for securing metal parts to plastic parts, but also for securing two plastic parts to each other, such as the body part 21 to the base part 33, although solvent welding is also suitable for plastic-to-plastic securement.

The next step is to place the heat-resistive filling in the space between the main body 21 and the metal liner. This is done while the body and liner are still in the inverted position, filling being accomplished through the open bottom of the safe, as the bottom is entirely open at this time, with a very large opening making it easy to pour the flowable filling material into the large top opening. Such material is indicated schematically as 61 in FIG. 1. The material itself may be of any known kind, and the composition of the filling material does not constitute part of the present invention, but the method of constructing the safe and method applying the material, pouring it in through the large bottom opening, is part of the present invention. The filling material may, for example, be of the kind disclosed in Brush and Burgess U.S. Pat. No. 4,048,926, granted Sept. 20, 1977, or any of the kinds disclosed in the pending application of Burgess and Avery, Ser. No. 062,910, filed Aug. 2, 1979.

After the filling is completed, a metal base plate 65 (FIG. 1) is applied to the safe to act as a closure plate for the filling opening which is really at the bottom of the safe but which is at the top when the safe is in the inverted filling position. This is a plate of sheet metal with a peripheral bead and flange 67 extending all the way around the periphery, seated in and secured firmly in a groove 69 formed as illustrated on the underside of an inwardly extending shoulder on the flange 39 of the base section 33 of the safe. Either of the adhesives above mentioned may be used.

Figure 4:
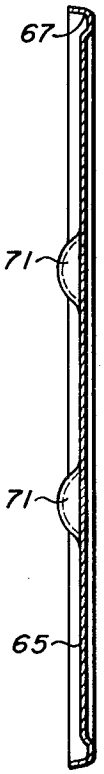
FIG. 4 is a section on the line 4—4 of FIG. 3.
Figure 3:
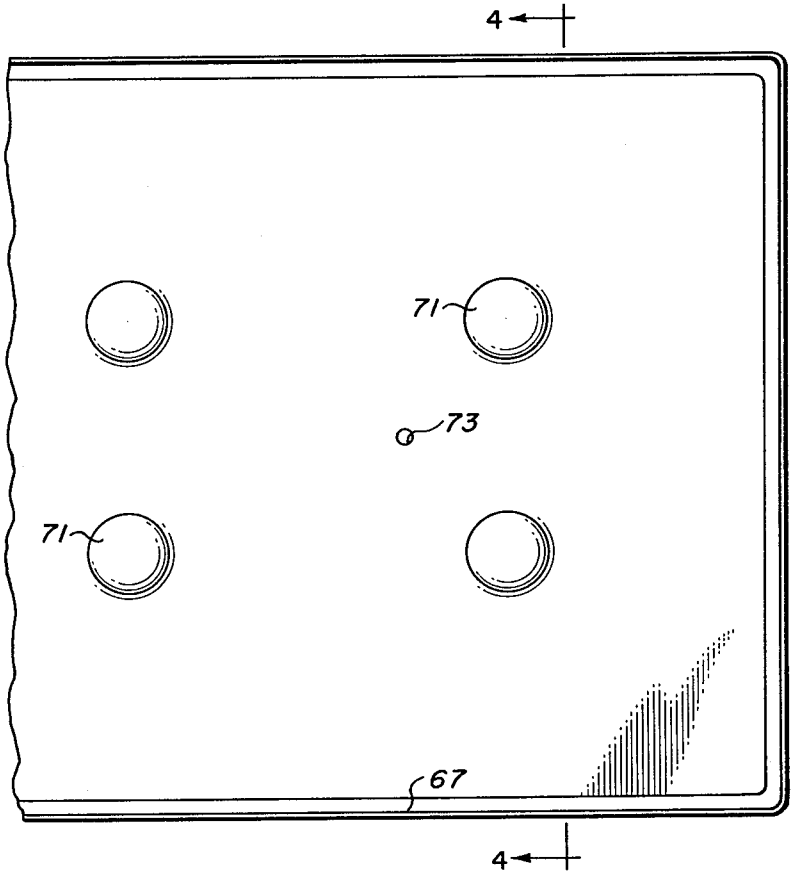
FIG. 3 is a fragmentary plan of a metal base plate forming part of the safe shown in FIG. 1.
Figure 3:
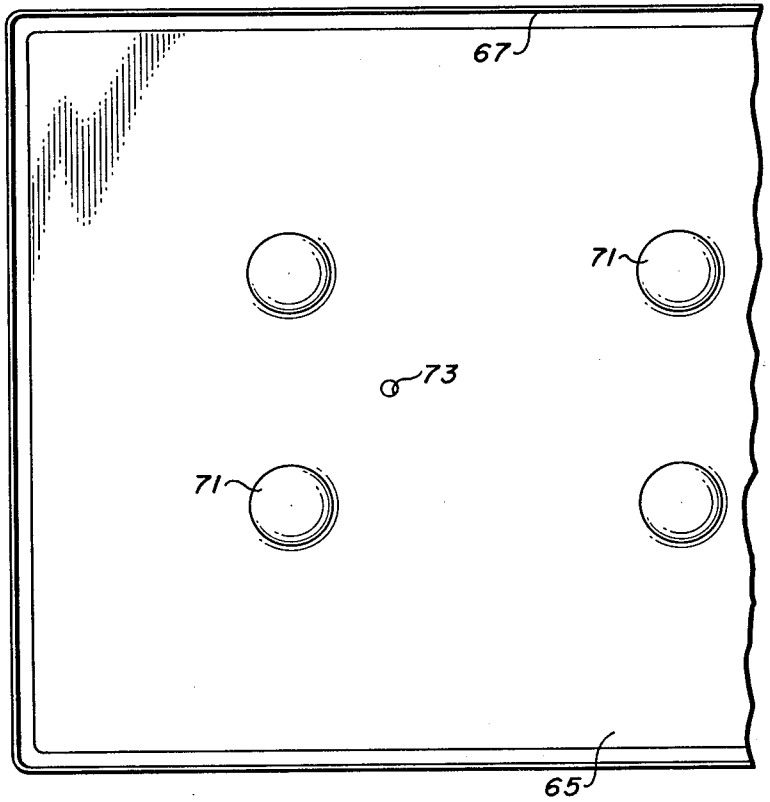

It should be noted especially that this metallic closure plate 65 is formed with projections 71 which extend upwardly above the main surface of the plate, these projections conveniently being in the form of protrusions of somewhat frusto-conical or dome shape pressed out of the metal of the plate, as illustrated in FIGS. 3 and 4. They have an important purpose. It is desirable to have the filling make contact with the plate, both to prevent vibration of the plate in a way that would produce a hollow sound if one were to tap the plate of a completed safe, and also to provide structural support for the plate at fairly close intervals. At the same time, it is desirable that the filling of the safe be done in a way to avoid slopping over the edges of the safe (in the inverted filling position) and this in turn means that filling should stop a little short of the absolute top of the space to be filled. If the closure plate were flat (except for the inturned marginal flange) it would be necessary to perform the filling operation with great precision to insure on the one hand that the filling material would come up to the level of the surface of the closure plate when the plate was put in place at the end of the filling operation, and on the other hand to prevent slopping the flowable filling material over the sides of the safe. But with the provision of these small dome-like projections 71, the filling operation can be discontinued when the fill material reaches a level slightly below the main plane of the closure plate. Then when the closure plate is placed in position, the projections or protrusions 71 will make contact with and extend partly down into the filling material. The safe is allowed to remain in the inverted filling position until the wet flowable filling has set or hardened at least partially, and then when the safe is turned to an upright position, the projections on the closure plate will still be in contact with the hardened filling material even though other areas of the closure plate may be slightly spaced from the filling material. Thus if one strikes the closure plate, the contact of the projections with the filling material will prevent the tinny or hollow sound, and if the safe is rested on an uneven surface so that pressure is applied against a particular area of the plate, the plate will not be distorted because it is adequately backed up or supported at rather close intervals throughout its entire area.

This closure plate also has two small rivet holes 73 (FIG. 3) formed through it. Two anchor members 75 (FIG. 1) made of strips of metal formed to a Z-shape are secured to the inner face of the closure plate, each by a single rivet 77 passing through one of the holes 73. These anchor members are easily embedded in the insulation filling which is still very soft and flowable at the time the closure plate is applied. If the safe drops some distance during a fire and tends to shatter, these anchors will help to keep the closure plate in place and prevent it from dropping away from the body of insulation material.

Figure 8:
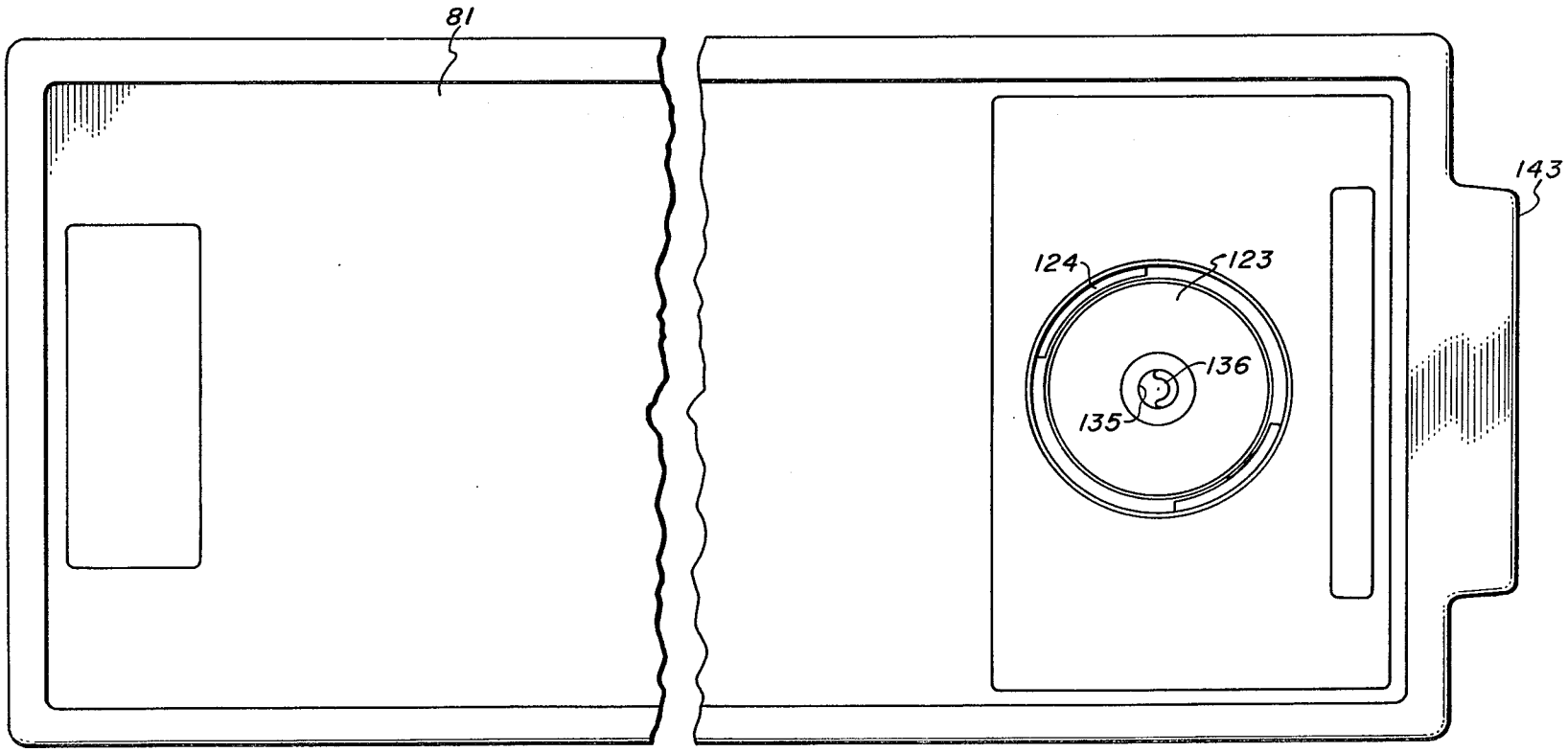
FIG. 8 is a fragmentary top plan view of the cover of the safe, removed from the rest of the safe.

The parts thus far described in detail constitute, in effect, a thick-walled container completely open at the top, so that envelopes or folders containing documents or other valuables can be very easily placed in the storage space of the safe, which is the space within the metal liner 45. The safe also includes a separate door member or cover member serving as a tight closure for the otherwise open top of the safe. This door is best seen in FIGS. 1 and 8.

The main part of this door is the top plate 81, of molded plastic material which may be the same as or similar to the plastic material from which the body parts 21 and 33 are formed. The plate 81 is of generally rectangular plan, having around most of its periphery a downwardly extending marginal flange 83 with a sharp tapered edge as illustrated in FIG. 1. However, the construction is somewhat different at the front end of the door, in the vicinity of the lock, as will be further described below.

Mating with this top plate member 81 is a jamb member 85 molded of the same or similar plastic material, having at its upper edge a groove for receiving the flange 83 of the top plate in permanently secured relation, and having its main portion extending downwardly and obliquely inwardly as illustrated in FIG. 1, at the proper angle to lie snugly against the angular part 25 of the door jamb portion of the safe body. At the lower edge of this angular portion 85 there is a flange 87 extending horizontally inwardly, in position to lie on the horizontal flange 27 of the body, when the door is in its closed position, and finally another inwardly and downwardly extending oblique angular flange 89 terminating in a horizontal flange 90. At two places as seen in FIG. 1, strips 92 extend across from the horizontal flange 90 on one side to the flange on the other side of the jamb member. These strips 92 originally serve as gating members during the molding operation, and subsequently provide mechanical strength to the molded jamb member and help to prevent warping thereof, during shipment and storage of this jamb member as a separate part, before assembly. This same construction extends around all four sides of the door except at the center of the front end where it is slightly different on account of the latch.

Secured to the lower face of the horizontal flange 90 and hermetically sealed thereto is a metal closure plate or door back plate 91. It may be secured by adhesive which may be the same as that used in attaching the metallic liner 45, 47 to the plastic portion 27 of the safe body, and in attaching the metallic base plate 65 to the plastic portion 39 of the safe body. Anchor members 93, similar to the anchor members 75, are riveted by rivets 94 to the inner face of the plate 91 and extend into the insulation filling 151 mentioned below.

At the center of the rear end of the door back plate 91 (left end of FIG. 1) there is a rearward extension 95 of the plate, and when the cover or door is placed in closed position on the safe body, this extension 95 fits under a forwardly projecting lug or ear 97 (FIGS. 1 and 7) formed near the top edge of the end plate 47 of the liner, thus holding the rear end of the door tightly down in closed position. A screw 98 extends upwardly through the plate 91 and is threaded into a screw socket 99 molded as part of the jamb member. This provides a mechanical connection to supplement the adhesive connection between the plate 91 and the jamb member, for better resistance to separation of these parts at the point of greatest stress if one attempts to pry the rear end of the cover out of the body of the safe.

Figure 9:
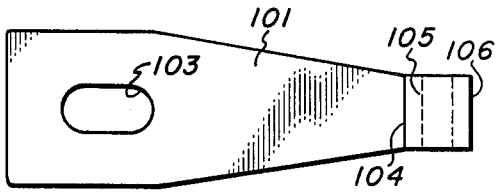
FIG. 9 is a plan view of a latch member for holding the cover in place on the body of the safe.
Figure 10:
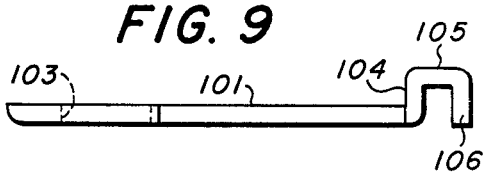
FIG. 10 is a side elevation of the latch member.

The front end plate of the liner is a duplicate of the rear end plate and likewise has the inwardly projecting flange 97. However, the front end of the metal back plate 91 of the door does not have the projection 95 to go under the flange 97. Instead, there is a metal latch or lock member 101 (FIGS. 1, 9, and 10) which lies on top of and slides longitudinally on the top face of the plate 91. When the latch member 101 is projected forwardly to its normal latching position, the foward end lies under the lug or ear 97 of the end plate of the liner, thus preventing this end of the door from being raised. This latch or lock member 101 has a longitudinal slot 103 (FIG. 9) near its front end. Its rear end is turned up at 104 (FIGS. 1, 9 and 10), then extends horizontally a short distance at 105, then vertically down at 106.

The front end of the jamb section 85 of the door is formed with an integral rearward extension 107 (FIG. 1) located approximately along the longitudinal center line, forming a housing for containing the latch member 101 and also containing a coiled compression spring 109 which presses rearwardly on the end 111 of this plastic housing and forwardly on the rear end 106 of the latch member, to bias the latch member to a normal projected or latching position. A screw 113 surrounded by a bushing or sleeve 115 projects upwardly through the metal plate 91 and through the slot 103 in the latch member, and is screwed into a screw socket 117 formed integrally in the plastic material of the door jamb section, similar to the socket 99. The sleeve 115 serves as a guide in the slot 103, and limits the extent of longitudinal movement of the latch member.

The plastic molded jamb section of the door also includes an upstanding tubular part 121 (FIGS. 1 and 13) to receive a key for unlocking the safe by withdrawing the latch against the force of the spring 109. The top face of the cover member 81 has a circular recess 123 (FIGS. 1, 8, 12, and 13) concentric with this tubular portion 121, the recess being adapted to receive the handle of the key. In this recess are two arcuate segments 124, about half as high as the depth of the recess, to limit the extent of turning the key handle when the key is fully inserted in proper operating position.

Figure 11:
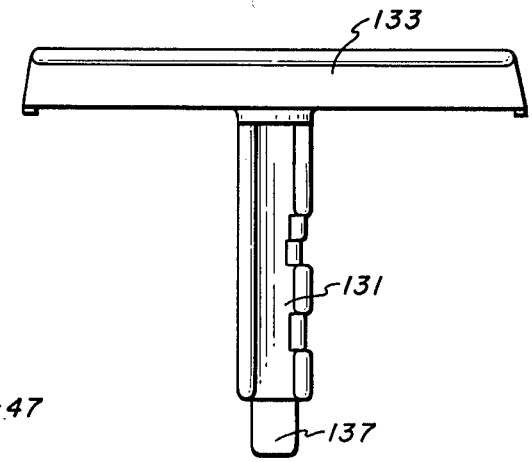
FIG. 11 is a side elevational view of a special key for withdrawing the latch member so that the cover may be removed to obtain access to the contents of the safe.

The key itself (FIG. 11) may be of die cast metal with an approximately semi-cylindrical shank 131 concavo-convex in cross section, and a diamentrical handle 133 at the upper end of the shank. The key receiving opening 135 (FIG. 8) in the member 81 is of circular shape and just below the member 81 a bushing 136 is freely rotatable in a socket formed in the upper end of the tubular part 121. The opening through the bushing is arcuate semi-circular, therefore the key shank can be inserted in only one position of orientation relative to the bushing, but in any position of orientation relative to the cover of the safe, since the bushing is free to rotate to any position of orientation. The purpose of the bushing is to close what would otherwise be a gaping hole, not only for the sake of appearance but also to prevent foreign objects from dropping into the hole.

To unlock the safe, the proper position of orientation of the key when inserting it is with the handle 133 extending crosswise of the length of the safe, and with the convex side of the key shank faced toward the forward end of the safe and the concave side of the shank toward the rear. This is the position illustrated in FIGS. 1, 12, and 13, and when the key is fully inserted or seated, the eccentric extension or bit 137 at the end of the key comes down in front of the upstanding flange 104 of the latch member. The diametrical ends of the key handle will now be down in the horizontal plane of the arcuate segments 124, which will prevent the handle from being turned counter-clockwise (viewed from above as in FIG. 12). But it may be turned clockwise through about 90 degrees, until further turning is stopped by the segments. During this turning, the bit 137 on the key shank will cam the flange 104 rearwardly against the force of the spring 109, withdrawing the forward end of the latch 101 from its locking position beneath the lug 97 on the liner of the safe. Keeping the latch withdrawn, the user may put his fingers in the finger notch 141 (FIG. 1) formed at the upper edge of the safe body opposite the latch, and lift up on the special lifting projection 143 (FIGS. 1 and 8) formed at the front end of the cover or door. Then when this end of the door is lifted, the rear end of the door can be slid forward slightly to bring the flange 95 out from under the lug 97, and then the door can be lifted completely off of the safe body, for unhampered access to the interior of the safe.

Figure 14:
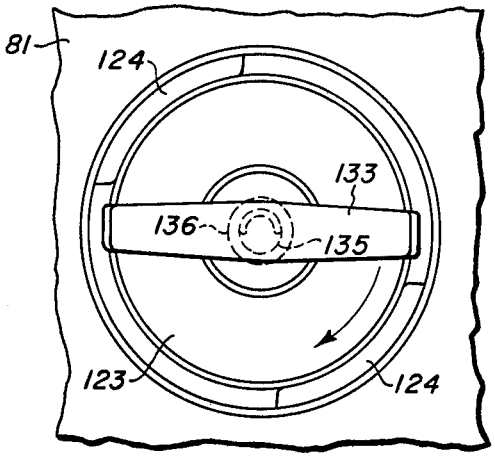
FIG. 14 is a view similar to FIG. 12 illustrating the key in an incorrect position of initial insertion.
Figure 12:
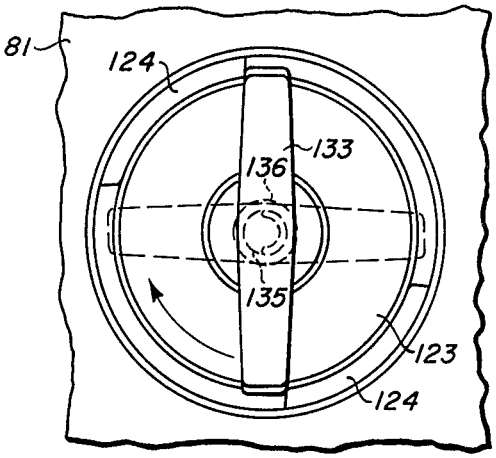
FIG. 12 is a top plan view of a fragment of the cover, showing the key in the correct position of initial insertion when the safe is to be opened.
Figure 15:
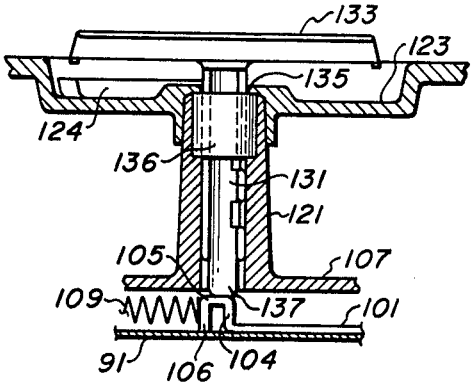
FIG. 15 is a view similar to FIG. 13 showing the relation of the key and the latch in this incorrect position of the key.
Figure 13:
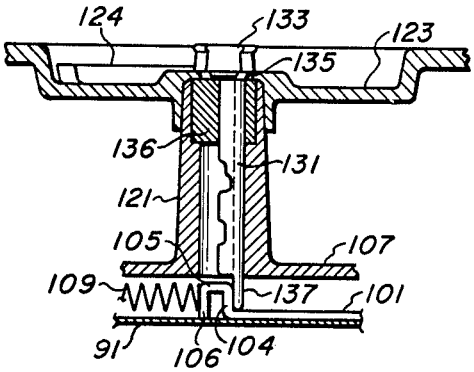
FIG. 13 is a vertical section through the parts positioned as in FIG. 12, plus the latch and associated parts.

If the user inserts the key in the wrong position of orientation, say for example with the handle extending lengthwise of the safe cover rather than crosswise, it will be in the position shown in FIGS. 14 and 15. The bit 137 at the end of the key shank will rest on top of the elevated flat surface 105 of the latch, holding the key sufficiently elevated so that the handle is above the level of the limiting segments 124. The handle may then be turned in either direction without interference from the segments 124, until it reaches the proper position of orientation for operating the latch as shown in FIGS. 12 and 13, and the the handle will drop down slightly to the operating position. The same is true if the handle is inserted crosswise of the cover, but turned 180 degrees from the proper position, that is, with the concave side of the shank forward and the convex side rearward. In this position also, the lower end will rest on the flat part 105 of the latch, holding the key elevated, and allowing it to be turned in either direction until it reaches the proper position and drops down. The flat elevated surface 105 extends sufficiently far rearwardly so that the bit 137 can never drop down to the rear of the surface 105 and the flange 106.

It should be noted that when the key is fully seated, the segments 124 limit the turning of the handle to just a little more than 90 degrees in a clockwise direction from the locked position, the extreme limit position being shown in broken lines in FIG. 12. In this position, the spring force applied to the latch 101 engages the key bit 137 at a point sufficiently off-center with respect to the axis of the key shank so that it can turn the shank back to the locking position, if the handle is released. If the user simply lets go of the handle, the safe will relock itself even if the key is left in the key hole, a valuable feature so far as fire protection is concerned.

This is a particularly advantageous latch or lock construction, very inexpensive to manufacture and easy to service. It may be completely disassembled from the end, upon removing just one screw 113 and its bushing 115.

This thickness of the door of the safe is filled with heat-resistive filling material, of the same kind as that used in filling the walls of the body of the safe. This filling is indicated schematically at 151 in FIG. 1. Posts or similar projections 153 molded integrally with the top member 81 of the door and projecting downwardly for a distance of, say, one half inch or one inch, are placed at intervals of about an inch and a half in each direction throughout the area of the top, and serve to make contact with the filling material even when there is a slight under-fill leaving a slight void at the top of the filling.

The preferred method or process for producing the door is to assemble the metal plate 91 to the door jamb section 85, 87, 89, 90. At this time the cover section 81 has not yet been put in place. Now the filling material 151 is poured into the shallow tray-like structure, and for the reasons already explained in connection with description of the filling of the main body of the safe, it is desirable not to fill quite to the top edge of the jamb section 85. This minimizes the risk of any spilling of the flowable filling mixture over the edges, and any risk of getting the filling mixture accidentally in the top groove which is later to receive the flange 83 of the cover section 81.

Then when filling is completed, the cover section 81 is put in place, and the flange 83 thereof is solvent welded into or otherwise secured in the receiving groove in the top edge of the jamb section 85. This extends all the way around the back edge, side edges, and the front edge. At the center of the front edge, where the latch is located, a screw 155 (FIG. 1) is screwed through the jamb section 85 into the cover section 81 as illustrated, to give additional strength to the connection of these parts at this point, because it is here that upward lifting pressure is applied to the lifting projection 143 on the cover 81.

After the filling material hardens, the cover panel 81 is adequately supported in a firm manner because of the posts or projections 153 extending down into the filling material even though the filling material may not reach quite to the level of the under surface of the panel 81. The top panel will not seem springy nor sound hollow when tapped.

It is been mentioned that the safe body may be built in different heights. The door can be the same for all heights, and also the plastic base section 37, 39 and the bottom metal plate 65 can be the same for safes of all heights. The difference would be in the height of the metal liner and the height of the main plastic body section 21, which in each case would have the same top dimensions and configuration, to fit the door, and the same bottom shape and configuration to fit the member 37, 39. For a higher body than that illustrated in FIG. 1, the slope of the side walls would therefore be somewhat less, and for a lower body, the slope would be somewhat greater.

Preferably these body sections 21, whether of the higher or lower variety, include four flanges 161 molded integrally into the interior angles of the four corners near the tops of the bodies, as illustrated in FIGS. 1 and 2. When a quantity of separate bodies (before assembly with other parts) are nested with each other for economy of space during shipment or storage, the bottom ends of the corner flanges 161 of one body rest on the flat top surface of the next body nested within the first one, thus limiting the extent to which one body nests into the next one and preventing the bodies from becoming wedged into each other so tightly that it is difficult and time-consuming to separate them when needed.

The shape of the base section 37, 39 is important in providing a downwardly faced horizontal surface a little above the floor level, for easy grasping to lift the safe. There is a grasping surface all the way around the bottom of the safe, rather narrow but nevertheless usable along the long sides of the safe and near the corners of the ends, but wider and easier to use at the center of each end, where one would naturally tend to grasp the safe to lift it. This makes the safe very convenient to move from place to place. A safe of this kind is intended primarily for protection of contents from the heat of a fire, rather than for burglary protection.

What is claimed is:

1. A safe construction comprising a base section of plastic material, a main body section of plastic material resting upon and firmly fixed to said base section, said body section having upstanding side walls sloping inwardly from bottom to top and also having a door jamb portion extending inwardly and obliquely downwardly from the top of the upstanding side walls, a metal bottom plate extending across and substantially closing the bottom of said base section, a metal liner having an upper edge affixed to said main body section near said jamb portion thereof, said liner having a bottom wall spaced upwardly from said metal bottom plate and having side walls spaced inwardly from said upstanding side walls, said liner forming a receptacle for containing articles to be protected, a filling of heat-resistive material in the space surrounding said liner within said main body section, said metal bottom plate having an inner face with a substantial area thereof out of contact with said filling, and a separate completely detachable door engaging said jamb portion and extending across the top of said liner, wherein said door is of substantial thickness, and includes a tubular key-receiving socket extending in a direction through the thickness of the door, a latch member slidably mounted within the thickness of the door and having an upstanding lug, and a spring acting on said lug to tend to project the latch member to an effective latching position, said lug being so placed with respect to said tubular socket that a rotary key shank placed in said socket may engage said lug to retract said latch against the force of said spring.

2. The invention defined in claim 1, further comprising means forming a channel within the thickness of the door for containing said latch member, one end of said channel being open at one edge of the door, said spring being in said channel and tending to eject said latch member through said open end of the channel, and a removable member engaging said latch member to limit movement thereof, said channel and said latch member and spring being so dimensioned that when said removable member is removed, said latch member and spring may be taken out through the open end of the channel.

3. A latch construction for a door, comprising a door member, means forming a channel having one substantially closed end and one end open at one edge of said door member, a latch member having an elongated portion extending lengthwise in said channel and an upstanding lug, a coiled spring in said channel between the closed end thereof and said latch member and acting to tend to eject said latch member from the open end of said channel, means forming a guide opening extending through the thickness of said door member in the vicinity of said lug, said guide opening being adapted to receive a key member with a portion to engage said lug to retract said latch member against the action of said spring, and removable abutment means including a removable screw for limiting the extent that said spring may move said latch member, said channel being so dimensioned that when said abutment means is removed, said latch member and spring may be taken out through the open end of the channel.

4. The invention defined in claim 3, wherein said guide member extending through the thickness of the door member is in the form of a tube (121) of circular cross section, and further comprising a bushing (136) rotatably mounted in said tube and having an arcuate slot extending therethrough, said key member having a shank (131) of arcuate cross section adapted to pass through said arcuate slot in said bushing and into said tube to engage said latch member.

5. A latch and key construction for a door, comprising a door member having an outer surface and an inner surface and a substantial thickness between said surfaces, a latch member (101) movably mounted within the thickness of said door member to move from a latching position projecting from an edge of the door member to a retracted unlatching position, a key guide member in the form of a tube (121) of circular cross section extending within the thickness of the door member from a position near said latch member toward said outer surface of the door member, a bushing (136) rotatably mounted in said tube and having an arcuate slot extending therethrough, and a key having a shank (131) of arcuate cross section adapted to pass through said arcuate slot in said bushing and into said tube to engage said latch member.

6. The invention defined in claim 5, wherein said key has a handle portion (133) extending crosswise relative to said shank and a bit portion (137) for engaging said latch member, and said outer surface of said door member has a recess around said tube, and handle portion and recess are so dimensioned that said bit portion will be in effective operating relation to said latch member only when said handle portion is properly seated fully in said recess.

7. The invention defined in claim 6, further comprising abutment means in said recess to limit the full seating of the handle in the recess to a predetermined range of positions of orientation therein and to limit the extent to which the handle can be turned while fully seated in the recess.

8. The invention defined in claim 7, further comprising spring means tending to move the latch member from unlatching position to latching position, wherein the latch member and key bit portion are so shaped that in any position to which the key handle can be turned while fully seated in the recess, the spring means will move the latch member to latching position if all torque force is removed from the handle.

9. The method of assembling a safe which comprises the steps of providing a hollow structure to receive a heat-resistive filling, pouring a quantity of such filling into the structure, discontinuing the pouring of filling when the space within the structure is less than completely full, so as to avoid spillage over the upper edges of the structure, and applying to the structure, over the filling, a covering member having an area which is mainly out of contact with the filling, the covering member having certain portions inwardly from the edges thereof which extend into firm contact with the filling.

* * * * *